US011063369B2

(12) United States Patent
Hwang et al.

(10) Patent No.: US 11,063,369 B2
(45) Date of Patent: Jul. 13, 2021

(54) ANTENNA ARRAY

(71) Applicant: Delta Electronics, Inc., Taoyuan (TW)

(72) Inventors: Chieh-Tsao Hwang, Taoyuan (TW); Yen-Ting Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 61 days.

(21) Appl. No.: 16/570,688

(22) Filed: Sep. 13, 2019

(65) Prior Publication Data

US 2021/0028554 A1 Jan. 28, 2021

(30) Foreign Application Priority Data

Jul. 24, 2019 (CN) ..... 201910672643.3

(51) Int. Cl.

| | |
|---|---|
| ***H01Q 21/00*** | (2006.01) |
| ***H01Q 21/06*** | (2006.01) |
| ***H01Q 3/26*** | (2006.01) |
| *H01Q 1/24* | (2006.01) |
| *H01Q 21/28* | (2006.01) |
| *H01Q 1/52* | (2006.01) |

(52) U.S. Cl.

CPC ..... *H01Q 21/061* (2013.01); *H01Q 3/26* (2013.01); *H01Q 1/246* (2013.01); *H01Q 1/523* (2013.01); *H01Q 21/0025* (2013.01); *H01Q 21/28* (2013.01)

(58) Field of Classification Search

CPC ..... H01Q 21/28; H01Q 1/523; H01Q 1/246; H01Q 21/061; H01Q 21/0025

See application file for complete search history.

(56) References Cited

U.S. PATENT DOCUMENTS

| | | | | |
|---|---|---|---|---|
| 4,353,067 | A * | 10/1982 | Mims | G01S 13/284 342/189 |
| 5,283,587 | A * | 2/1994 | Hirshfield | H01Q 21/064 342/372 |
| 6,501,436 | B1 | 12/2002 | Saito et al. | |
| 7,498,989 | B1 | 3/2009 | Volman | |
| 10,014,572 | B2 | 7/2018 | Tagi et al. | |
| 10,326,196 | B2 | 6/2019 | Kim et al. | |
| 2003/0011522 | A1 | 1/2003 | McKinzie, III et al. | |

(Continued)

FOREIGN PATENT DOCUMENTS

| | | | |
|---|---|---|---|
| CN | 102823062 | B | 11/2014 |
| CN | 104157982 | A | 11/2014 |

(Continued)

OTHER PUBLICATIONS

European Search Report dated May 8, 2020 in EP Application No. 19203100.3, 17 pages.

(Continued)

*Primary Examiner* — Joseph J Lauture

(74) *Attorney, Agent, or Firm* — Muncy, Geissler, Olds & Lowe, P.C.

(57) ABSTRACT

An antenna array includes a plurality of antenna elements disposed on the same plane. The antenna elements are arranged to form a symmetrical pattern. The symmetrical pattern is neither square nor rectangular. The antenna elements have the same output power. The radiation pattern of the antenna array includes a main lobe and a side lobe. The main lobe is higher than the side lobe by at least 18 dB.

18 Claims, 10 Drawing Sheets

(56) References Cited

U.S. PATENT DOCUMENTS

| | | | |
|---|---|---|---|
| 2003/0090433 | A1 | 5/2003 | Ohtsuka et al. |
| 2005/0162326 | A1 | 7/2005 | Steyn et al. |
| 2006/0132375 | A1 | 6/2006 | Kim et al. |
| 2014/0028524 | A1 | 1/2014 | Jerauld et al. |
| 2014/0049437 | A1 | 2/2014 | Hung et al. |
| 2014/0354513 | A1 | 12/2014 | Nair et al. |
| 2015/0035714 | A1 | 2/2015 | Zhou |
| 2016/0028161 | A1 | 1/2016 | Kawaguchi et al. |
| 2016/0282462 | A1 | 9/2016 | Pitts et al. |
| 2018/0241135 | A1* | 8/2018 | Furlan ..... H01Q 21/0006 |
| 2018/0241442 | A1 | 8/2018 | Zirwas et al. |
| 2019/0089069 | A1 | 3/2019 | Niroo et al. |
| 2019/0098750 | A1 | 3/2019 | Woo |

FOREIGN PATENT DOCUMENTS

| | | | |
|---|---|---|---|
| CN | 207732097 | U | 8/2018 |
| CN | 106129638 | B | 6/2019 |
| CN | 109904605 | A | 6/2019 |
| DE | 102016014385 | A1 | 6/2018 |
| DE | 112017000954 | T5 | 11/2018 |
| DE | 112017001941 | T5 | 1/2019 |
| JP | H-0591019 | U | 12/1993 |
| JP | H-07235828 | A | 9/1995 |
| JP | 2007142878 | A | 6/2007 |
| JP | 2014179680 | A | 9/2014 |
| TW | I-631769 | B | 8/2018 |

OTHER PUBLICATIONS

European Search Report dated May 18, 2020 in EP Application No. 19206962.3, 9 pages.
European Search Report dated Nov. 25, 2020 in EP Application No. 20186251.3, 10 pages.
Office Action dated Feb. 9, 2021 in JP Application No. 2019-221884, 8 pages.
Office Action dated Feb. 23, 2021 in JP Application No. 2020-008378, 3 pages.
Office Action dated Mar. 19, 2021 in TW Application No. 108126077, 4 pages.
Office Action dated Mar. 17, 2021 in TW Application No. 108126078, 5 pages.
Office Action dated Sep. 24, 2021 in TW Application No. 108126078, 5 pages.
Office Action dated Jan. 15, 2020 in U.S. Appl. No. 16/568,867, 14 pages.
Office Action dated Feb. 24, 2021 in U.S. Appl. No. 16/568,867, 17 pages.
Tsai et al., "A Low-Cost Efficient Antenna Array for Wireless Local-Loop Systems," 2000 IEEE-APS Conference on Antennas and Propagation Wireless Communications, 6 pages.

* cited by examiner

ANTENNA ARRAY

CROSS REFERENCE TO RELATED APPLICATIONS

This application claims priority of China Patent Application No. 201910672643.3 filed on Jul. 24, 2019, the entirety of which is incorporated by reference herein.

BACKGROUND OF THE INVENTION

Field of the Invention

The disclosure generally relates to an antenna array, and more particularly, it relates to an antenna array for suppressing the side lobe and increasing the communication distance.

Description of the Related Art

FIG. 1A is a top view of a conventional antenna array 100. As shown in FIG. 1A, the conventional antenna array 100 includes a plurality of antenna elements 110. The antenna elements 110 are arranged to form a square shape (or a rectangular shape).

FIG. 1B is diagram of the radiation pattern 190 of the conventional antenna array 100. The horizontal axis represents the zenith angle (Theta), and the vertical axis represents the normalized radiation power. As shown in FIG. 1B, the radiation pattern 190 of the antenna array 100 includes a main lobe 191 and a side lobe 192. The main lobe 191 is higher than the side lobe 192 by only about 13 dB, which is worse than the general standard of 18 dB. The drawback of the conventional antenna array 100 is directed to the poor side lobe suppression ratio, thereby negatively affecting the spatial efficiency of the conventional antenna array 100.

In order to improve the side lobe suppression ratio, a designer can fine-tune the output power of the antenna elements 110. For example, a portion of the antenna elements 110 within the central region 130 of the antenna array 100 may have relatively high output power, and another portion of the antenna elements 110 within the edge region 140 of the antenna array 100 may have relatively low output power. The aforementioned non-uniform distribution of the output power can increase the side lobe suppression ratio; however, it may decrease the communication distance of the conventional antenna array 100. Accordingly, there is a need to propose a novel solution for solving the problems of the prior art.

BRIEF SUMMARY OF THE INVENTION

In an exemplary embodiment, the disclosure is directed to an antenna array including a plurality of antenna elements disposed on the same plane. The antenna elements are arranged to form a symmetrical pattern. The symmetrical pattern is neither square nor rectangular. The antenna elements have the same output power.

In some embodiments, the radiation pattern of the antenna array includes a main lobe and a side lobe. The main lobe is higher than the side lobe by at least 18 dB.

In some embodiments, the antenna array covers an operation frequency band from 27 GHz to 29 GHz.

In some embodiments, the distance between any adjacent two of the antenna elements is shorter than or equal to 0.5 wavelength of the operation frequency band.

In some embodiments, the symmetrical pattern substantially has a regular hexagonal shape, and the antenna elements are distributed over the periphery and the interior of the regular hexagonal shape.

In some embodiments, the regular hexagonal shape is divided into a first straight line, a second straight line, a third straight line, a fourth straight line, a fifth straight line, a sixth straight line, a seventh straight line, an eighth straight line, and a ninth straight line which are substantially parallel to each other.

In some embodiments, five of the antenna elements are arranged on the first straight line, six of the antenna elements are arranged on the second straight line, seven of the antenna elements are arranged on the third straight line, eight of the antenna elements are arranged on the fourth straight line, nine of the antenna elements are arranged on the fifth straight line, eight of the antenna elements are arranged on the sixth straight line, seven of the antenna elements are arranged on the seventh straight line, six of the antenna elements are arranged on the eighth straight line, and five of the antenna elements are arranged on the ninth straight line.

In some embodiments, the symmetrical pattern substantially has a concentric circular shape, and the antenna elements are distributed over the periphery and the interior of the concentric circular shape.

In some embodiments, the concentric circular shape is divided into a first circumference, a second circumference, a third circumference, a fourth circumference, and a fifth circumference, all of which have the same center.

In some embodiments, one of the antenna elements is arranged at the center of the circle, four of the antenna elements are arranged on the first circumference, eight of the antenna elements are arranged on the second circumference, twelve of the antenna elements are arranged on the third circumference, sixteen of the antenna elements are arranged on the fourth circumference, and twenty of the antenna elements are arranged on the fifth circumference.

In some embodiments, the symmetrical pattern substantially has a diamond shape, and the antenna elements are distributed over the periphery and the interior of the diamond shape.

In some embodiments, the antenna elements over the diamond shape are arranged according to binomial coefficients.

In some embodiments, the diamond shape is divided into a first straight line, a second straight line, and a third straight line which are substantially parallel to each other.

In some embodiments, one of the antenna elements is arranged on the first straight line, two of the antenna elements are arranged on the second straight line, and one of the antenna elements is arranged on the third straight line.

In some embodiments, the diamond shape is divided into a first straight line, a second straight line, a third straight line, and a fourth straight line which are substantially parallel to each other.

In some embodiments, one of the antenna elements is arranged on the first straight line, three of the antenna elements are arranged on the second straight line, three of the antenna elements are arranged on the third straight line, and one of the antenna elements is arranged on the fourth straight line.

In some embodiments, the diamond shape is divided into a first straight line, a second straight line, a third straight line, a fourth straight line, and a fifth straight line which are substantially parallel to each other.

In some embodiments, one of the antenna elements is arranged on the first straight line, four of the antenna elements are arranged on the second straight line, six of the antenna elements are arranged on the third straight line, four of the antenna elements are arranged on the fourth straight line, and one of the antenna elements is arranged on the fifth straight line.

In some embodiments, the diamond shape is divided into a first straight line, a second straight line, a third straight line, a fourth straight line, a fifth straight line, and a sixth straight line which are substantially parallel to each other.

In some embodiments, one of the antenna elements is arranged on the first straight line, five of the antenna elements are arranged on the second straight line, ten of the antenna elements are arranged on the third straight line, ten of the antenna elements are arranged on the fourth straight line, five of the antenna elements are arranged on the fifth straight line, and one of the antenna elements is arranged on the sixth straight line.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
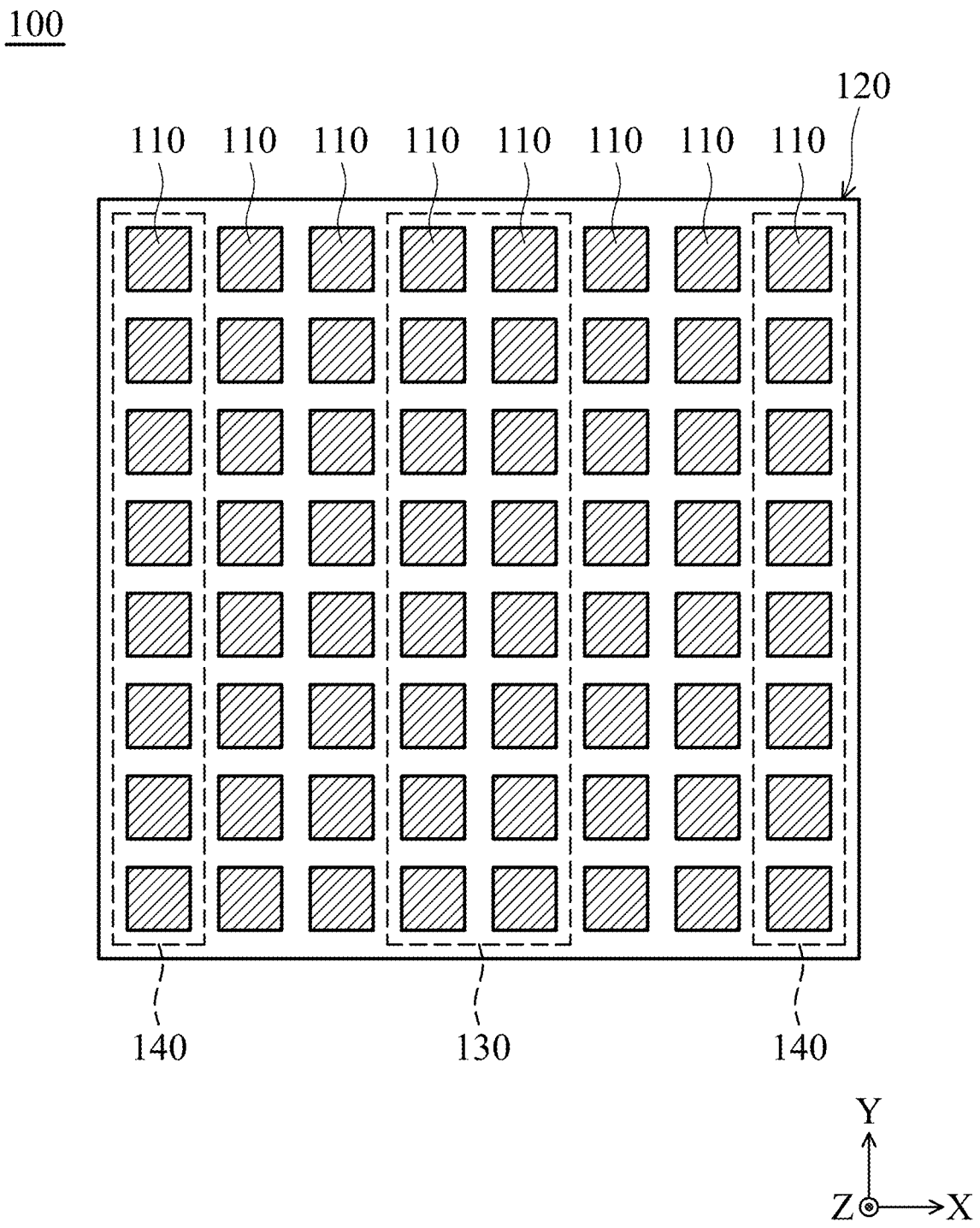
FIG. 1A is a top view of a conventional antenna array.
Figure 1B:
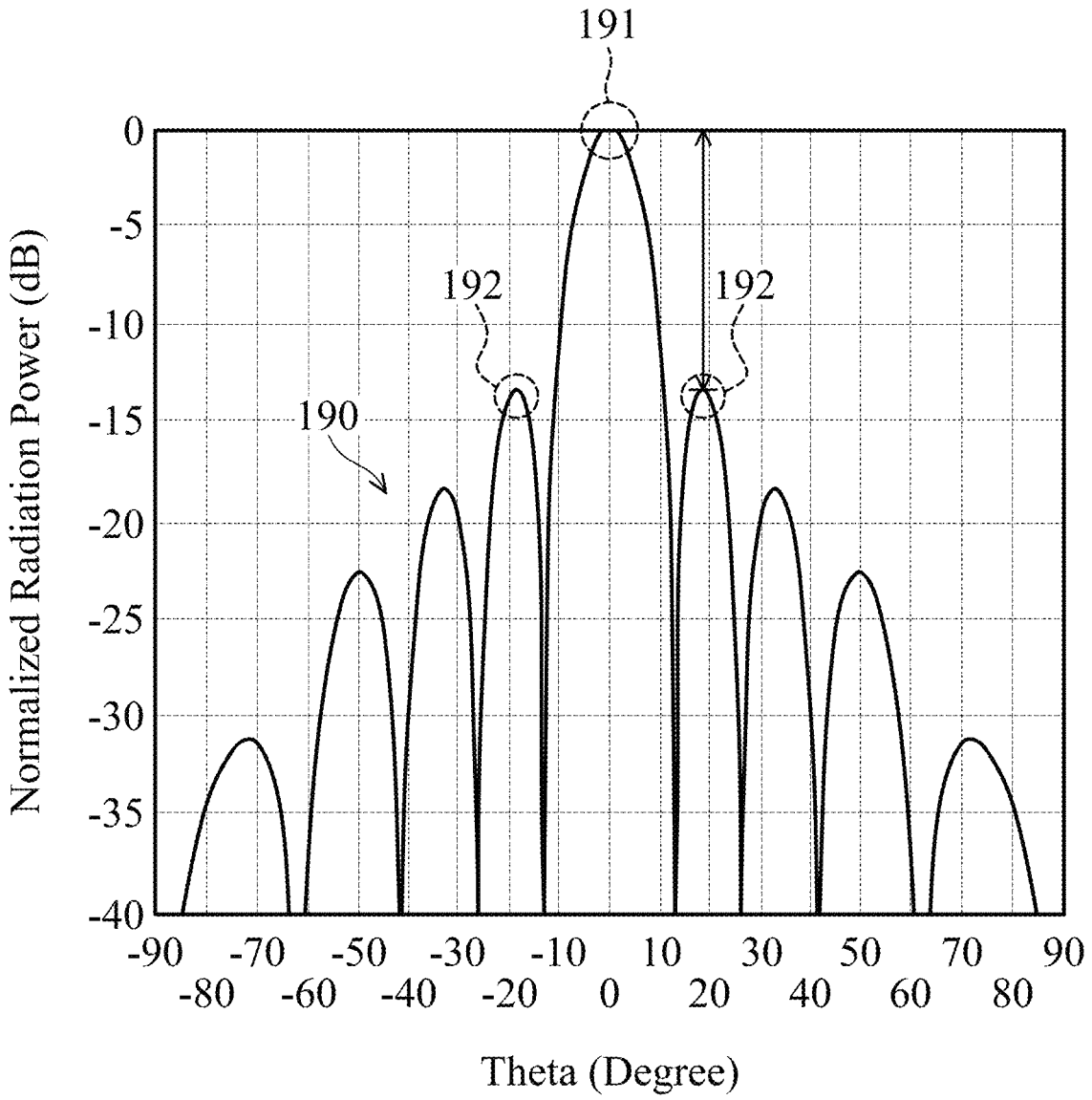
FIG. 1B is diagram of a radiation pattern of a conventional antenna array.
Figure 2A:
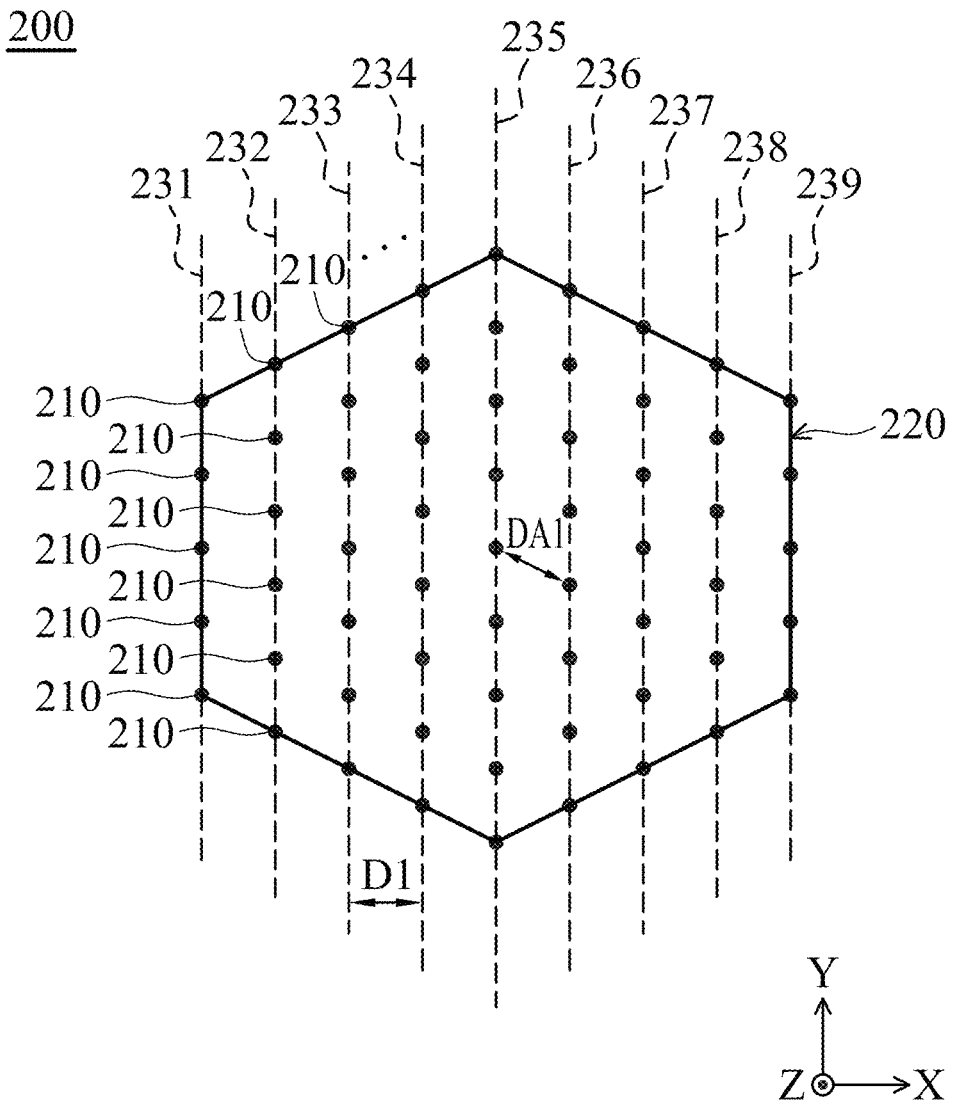
FIG. 2A is a top view of an antenna array according to an embodiment of the invention.

FIG. 2A is a top view of an antenna array 200 according to an embodiment of the invention. As shown in FIG. 2A, the antenna array 200 includes a plurality of antenna elements 210, which are all disposed on the same plane. To simplify the figure, each antenna element 210 is represented by a black dot. The shapes and types of the antenna elements 210 are not limited in the invention. For example, each of the antenna elements 210 may be a patch antenna, a monopole antenna, a dipole antenna, a bowtie antenna, a loop antenna, a helical antenna, or a chip antenna, but it is not limited thereto. The antenna elements 210 are arranged to form a symmetrical pattern 220. The difference from the conventional design is that the symmetrical pattern 220 is neither square nor rectangular. In addition, it should be noted that the antenna elements 210 have the same output power. That is, each of the antenna elements 210 may receive the same feeding signal power from a corresponding signal source or a corresponding power amplifier (not shown), and therefore these antenna elements 210 can provide equalized output power.

In the embodiment of FIG. 2A, the symmetrical pattern 220 substantially has a regular hexagonal shape, and the antenna elements 210 are distributed over the periphery and the interior of the regular hexagonal shape. For example, a portion of the antenna elements 210 inside the symmetrical pattern 220 may be uniformly distributed. Specifically, the regular hexagonal shape may be divided into a first straight line 231, a second straight line 232, a third straight line 233, a fourth straight line 234, a fifth straight line 235, a sixth straight line 236, a seventh straight line 237, an eighth straight line 238, and a ninth straight line 239 which are substantially parallel to each other. For example, the total number of antenna elements 210 of the antenna array 200 may be 61. There may be 5 antenna elements 210 arranged on the first straight line 231. There may be 6 antenna elements 210 arranged on the second straight line 232. There may be 7 antenna elements 210 arranged on the third straight line 233. There may be 8 antenna elements 210 arranged on the fourth straight line 234. There may be 9 antenna elements 210 arranged on the fifth straight line 235. There may be 8 antenna elements 210 arranged on the sixth straight line 236. There may be 7 antenna elements 210 arranged on the seventh straight line 237. There may be 6 antenna elements 210 arranged on the eighth straight line 238. There may be 5 antenna elements 210 arranged on the ninth straight line 239. It should be understood that the above arrangement numbers of antenna elements 210 are merely exemplary, and they may be adjusted to meet different requirements.

In some embodiments, the antenna array 200 covers an operation frequency band from 27 GHz to 29 GHz, so as to support the wideband operation of 5G millimeter-wave systems. With respect to the elements sizes, the distance D1 between any adjacent two of the first straight line 231, the second straight line 232, the third straight line 233, the fourth straight line 234, the fifth straight line 235, the sixth straight line 236, the seventh straight line 237, the eighth straight line 238, and the ninth straight line 239 may be the same. Generally, the antenna elements 210 almost form a honeycomb pattern, and thus the distance DA1 between any two adjacent antenna elements 210 may be the same. For example, the aforementioned distance DA1 may be shorter than or equal to 0.5 wavelength ($\lambda/2$) of the operation frequency band of the antenna array 200. The above ranges of distances are calculated and obtained according to many experiment results, and they help to optimize the side lobe suppression ration of the antenna array 200.

Figure 2B:
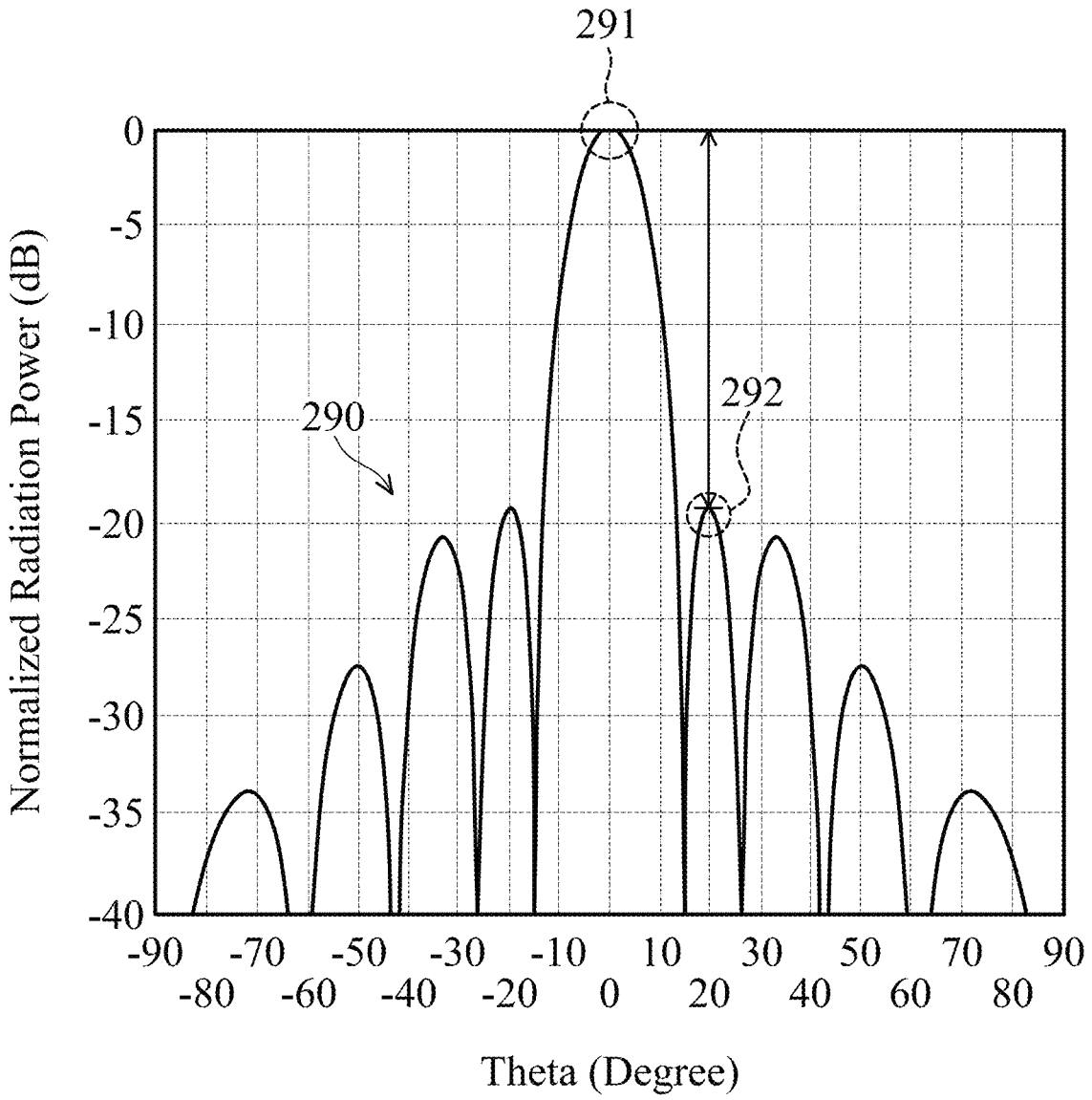
FIG. 2B is a diagram of a radiation pattern of an antenna array according to an embodiment of the invention.

FIG. 2B is a diagram of a radiation pattern 290 of the antenna array 200 according to an embodiment of the invention. The horizontal axis represents the zenith angle (Theta), and the vertical axis represents the normalized radiation power. According to the measurement of FIG. 2B, the radiation pattern 290 of the antenna array 200 includes a main lobe 291 and a side lobe 292. The main lobe 291 is higher than the side lobe 292 by about 19.4 dB, which is better than the general standard of 18 dB. Furthermore, since the antenna elements 210 have the same output power, the EIRP (Equivalent Isotropic Radiated Power) of the antenna array 200 is higher than that of the conventional antenna array 100 by about 2.5 dB, and the communication distance of the antenna array 200 is longer than that of the conventional antenna array 100 by about 33%.

Figure 3A:
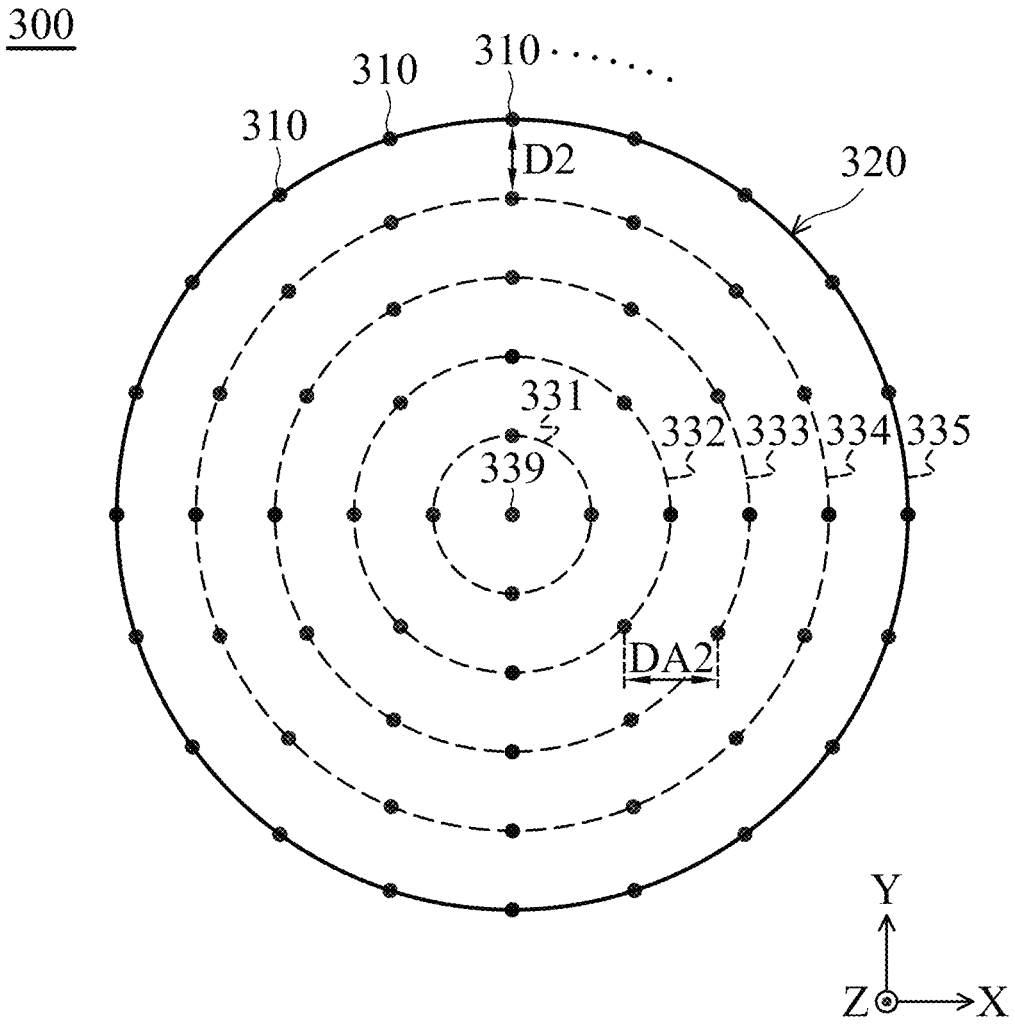
FIG. 3A is a top view of an antenna array according to an embodiment of the invention.

FIG. 3A is a top view of an antenna array 300 according to an embodiment of the invention. As shown in FIG. 3A, the antenna array 300 includes a plurality of antenna elements 310, which are all disposed on the same plane. The antenna elements 310 are arranged to form a symmetrical pattern 320, which is neither square nor rectangular. The antenna elements 310 have the same output power. In the embodiment of FIG. 3A, the symmetrical pattern 320 substantially has a concentric circular shape, and the antenna elements 310 are distributed over the periphery and the interior of the concentric circular shape. For example, a portion of the antenna elements 310 inside the symmetrical pattern 320 may be uniformly distributed. Specifically, the concentric circular shape may be divided into a first circumference 331, a second circumference 332, a third circumference 333, a fourth circumference 334, and a fifth circumference 335 which share a center 339 of a circle. For example, the total number of antenna elements 310 of the antenna array 300 may be 61. There may be 1 antenna element arranged at the center 339 of the circle. There may be 4 antenna elements arranged on the first circumference 331, and the distance between any two adjacent antenna elements 310 on the first circumference 331 may be the same. There may be 8 antenna elements arranged on the second circumference 332, and the distance between any two adjacent antenna elements 310 on the second circumference 332 may be the same. There may be 12 antenna elements arranged on the third circumference 333, and the distance between any two adjacent antenna elements 310 on the third circumference 333 may be the same. There may be 16 antenna elements arranged on the fourth circumference 334, and the distance between any two adjacent antenna elements 310 on the fourth circumference 334 may be the same. There may be 20 antenna elements arranged on the fifth circumference 335, and the distance between any two adjacent antenna elements 310 on the fifth circumference 335 may be the same. It should be understood that the above arrangement numbers of antenna elements 310 are merely exemplary, and they may be adjusted to meet different requirements.

In some embodiments, the antenna array 300 covers an operation frequency band from 27 GHz to 29 GHz, so as to support the wideband operation of 5G millimeter-wave systems. With respect to the elements sizes, the distance D2 between any adjacent two of the center 339, the first circumference 331, the second circumference 332, the third circumference 333, the fourth circumference 334, and the fifth circumference 335 may be the same. The distance DA2 between any two adjacent antenna elements 310 may be shorter than or equal to 0.5 wavelength ($\lambda/2$) of the operation frequency band of the antenna array 300. The above ranges of distances are calculated and obtained according to many experiment results, and they help to optimize the side lobe suppression ration of the antenna array 300.

Figure 3B:
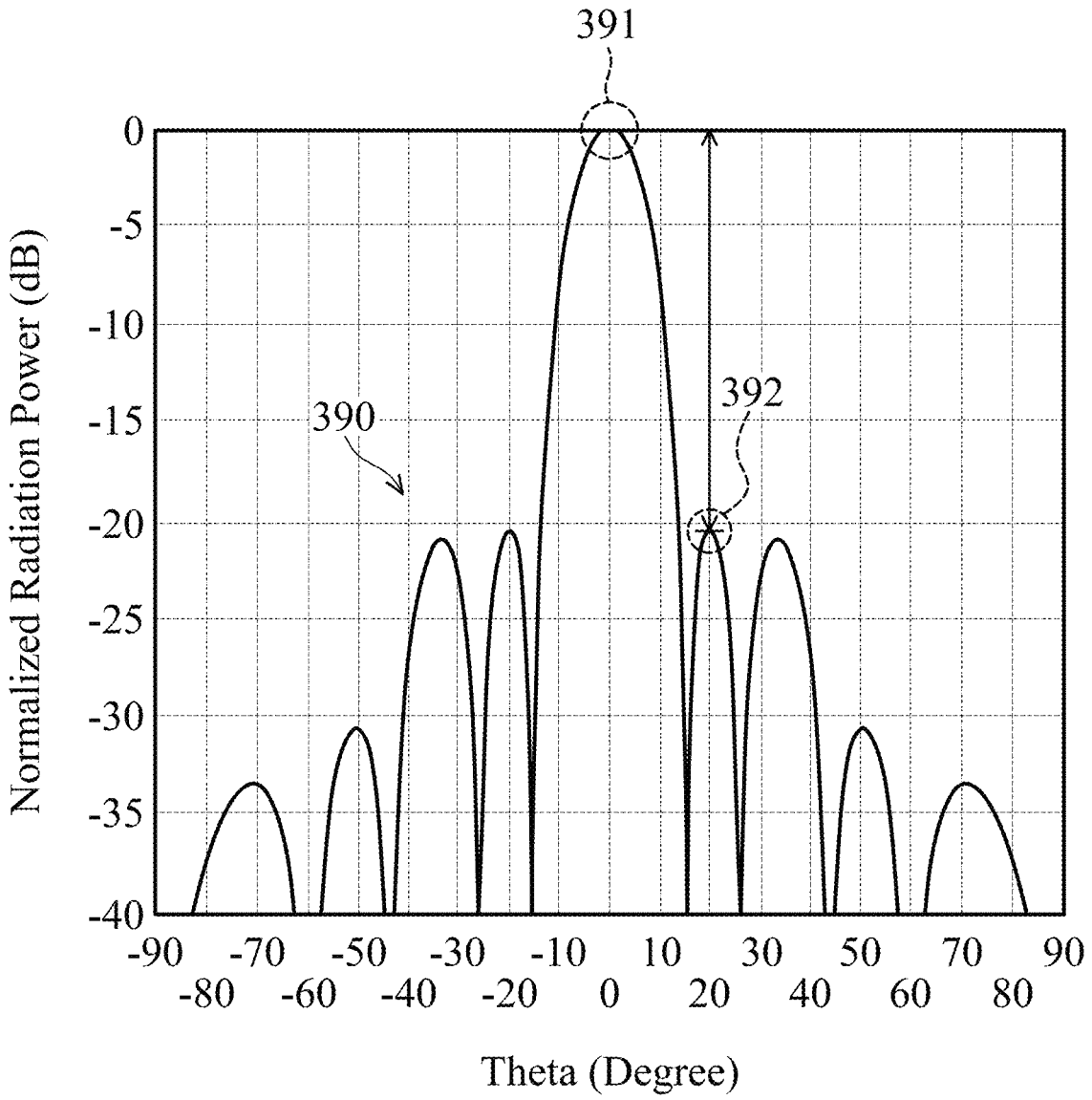
FIG. 3B is a diagram of a radiation pattern of an antenna array according to an embodiment of the invention.

FIG. 3B is a diagram of a radiation pattern 390 of the antenna array 300 according to an embodiment of the invention. The horizontal axis represents the zenith angle (Theta), and the vertical axis represents the normalized radiation power. According to the measurement of FIG. 3B, the radiation pattern 390 of the antenna array 300 includes a main lobe 391 and a side lobe 392. The main lobe 391 is higher than the side lobe 392 by about 21 dB, which is better than the general standard of 18 dB. Furthermore, since the antenna elements 310 have the same output power, the EIRP of the antenna array 300 is higher than that of the conventional antenna array 100 by about 2.8 dB, and the communication distance of the antenna array 300 is longer than that of the conventional antenna array 100 by about 38%. Other features of the antenna array 300 of FIG. 3A and FIG. 3B are similar to those of the antenna array 200 of FIG. 2A and FIG. 2B. Therefore, the two embodiments can achieve similar levels of performance.

In alternative embodiments, adjustments are made such that the aforementioned symmetrical pattern 220 or 320 has a regular pentagonal shape, a regular heptagonal shape, a regular octagonal shape, a regular enneagonal shape, or a regular decagonal shape, but it is not limited thereto.

Figure 4A:
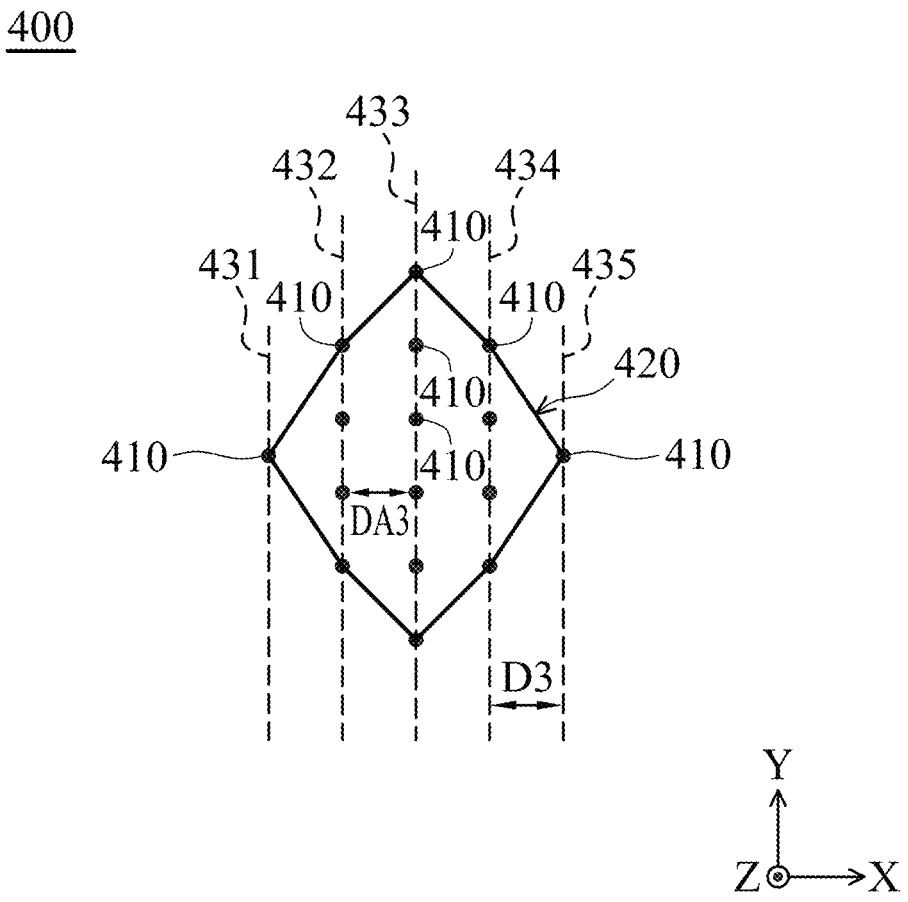
FIG. 4A is a top view of an antenna array according to an embodiment of the invention.

FIG. 4A is a top view of an antenna array 400 according to an embodiment of the invention. As shown in FIG. 4A, the antenna array 400 includes a plurality of antenna elements 410, which are all disposed on the same plane. The antenna elements 410 are arranged to form a symmetrical pattern 420, which is neither square nor rectangular. The antenna elements 410 have the same output power. In the embodiment of FIG. 4A, the symmetrical pattern 420 substantially has a diamond shape, and the antenna elements 410 are distributed over the periphery and the interior of the diamond shape. For example, a portion of the antenna elements 410 inside the symmetrical pattern 420 may be uniformly distributed. Specifically, the diamond shape of the symmetrical pattern 420 may be divided into a first straight line 431, a second straight line 432, a third straight line 433, a fourth straight line 434, and a fifth straight line 435, which are substantially parallel to each other. For example, the total number of antenna elements 410 of the antenna array 400 may be 16. There may be 1 antenna element 410 arranged on the first straight line 431. There may be 4 antenna elements 410 arranged on the second straight line 432, and the distance between any two adjacent antenna elements 410 on the second straight line 432 may be the same. There may be 6 antenna elements 410 arranged on the third straight line 433, and the distance between any two adjacent antenna elements 410 on the third straight line 433 may be the same. There may be 4 antenna elements 410 arranged on the fourth straight line 434, and the distance between any two adjacent antenna elements 410 on the fourth straight line 434 may be the same. There may be 1 antenna element 410 arranged on the fifth straight line 435. It should be understood that the above arrangement numbers of antenna elements 410 are merely exemplary, and they may be adjusted to meet different requirements.

In some embodiments, the antenna array 400 covers an operation frequency band from 27 GHz to 29 GHz, so as to support the wideband operation of 5G millimeter-wave systems. With respect to the elements sizes, the distance D2 between any adjacent two of the first straight line 431, the second straight line 432, the third straight line 433, the fourth straight line 434, and the fifth straight line 435 may be the same. The distance DA3 between any two adjacent antenna elements 410 may be shorter than or equal to 0.5 wavelength (λ/2) of the operation frequency band of the antenna array 400. The above ranges of distances are calculated and obtained according to many experiment results, and they help to optimize the side lobe suppression ration of the antenna array 400.

Figure 4B:
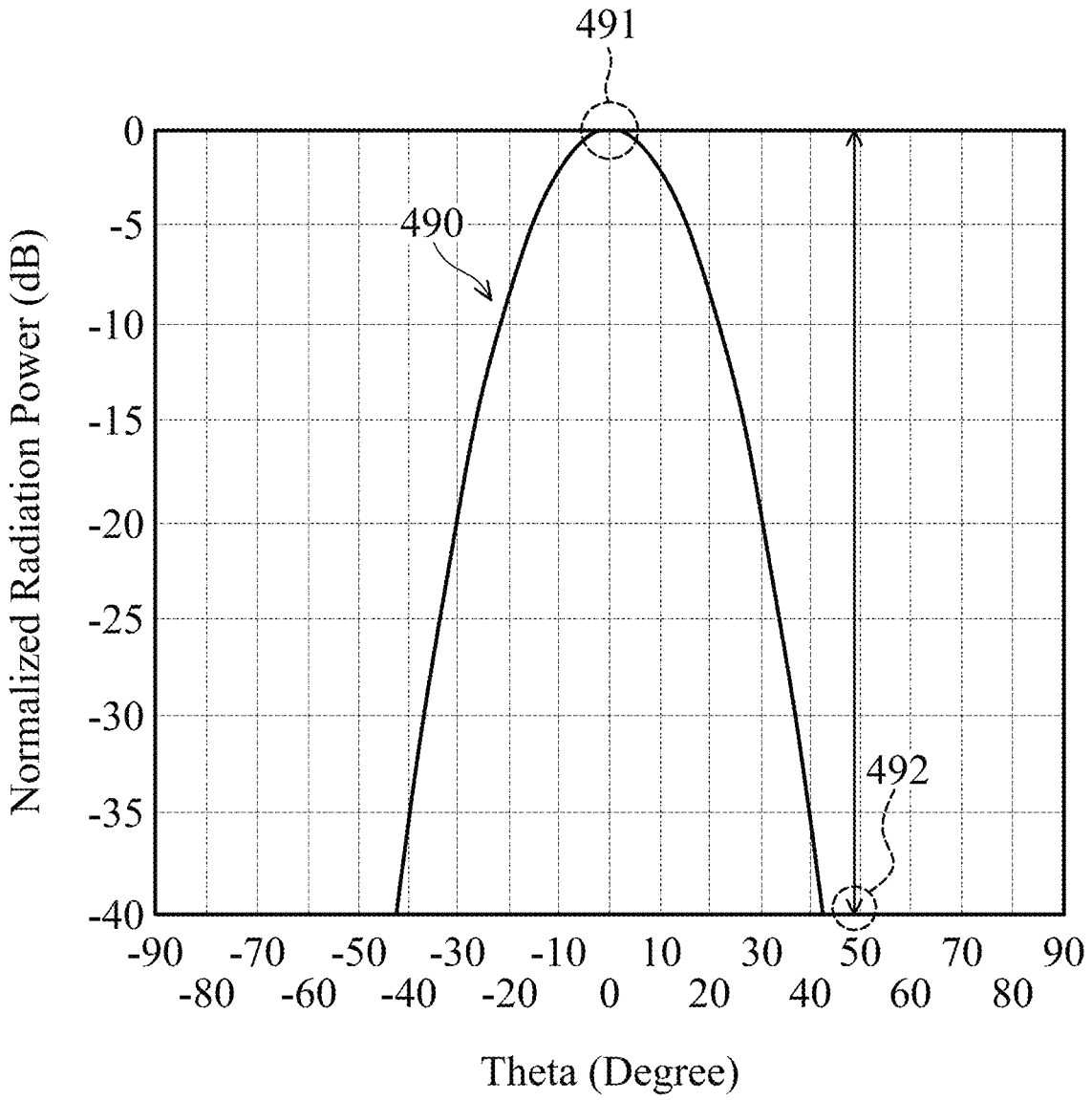
FIG. 4B is a diagram of a radiation pattern of an antenna array according to an embodiment of the invention.

FIG. 4B is a diagram of a radiation pattern 490 of the antenna array 400 according to an embodiment of the invention. The horizontal axis represents the zenith angle (Theta), and the vertical axis represents the normalized radiation power. According to the measurement of FIG. 4B, the radiation pattern 490 of the antenna array 400 includes a main lobe 491 and a side lobe 492. The main lobe 491 is higher than the side lobe 492 by at least 40 dB or more, which is better than the general standard of 18 dB. It should be noted that the side lobe 492 of the radiation pattern 490 is almost eliminated in comparison to the main lobe 491. Furthermore, since the antenna elements 410 have the same output power, the ERP of the antenna array 400 is higher than that of the conventional antenna array 100 by about 5.5 dB, and the communication distance of the antenna array 400 is longer than that of the conventional antenna array 100 by about 87.5%. Other features of the antenna array 400 of FIG. 4A and FIG. 4B are similar to those of the antenna array 200 of FIG. 2A and FIG. 2B. Therefore, the two embodiments can achieve similar levels of performance.

Figure 5:
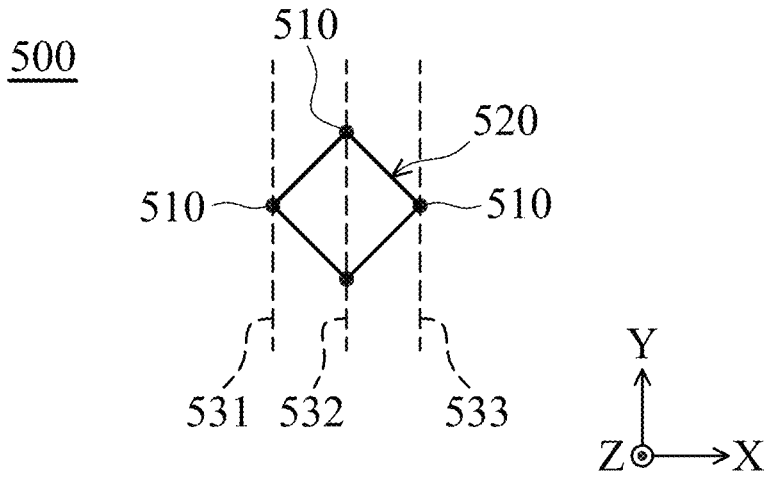
FIG. 5 is a top view of an antenna array according to an embodiment of the invention.

FIG. 5 is a top view of an antenna array 500 according to an embodiment of the invention. As shown in FIG. 5, the antenna array 500 includes a plurality of antenna elements 510, which are all disposed on the same plane. The antenna elements 510 are arranged to form a symmetrical pattern 520, which is neither square nor rectangular. The antenna elements 510 have the same output power. In the embodiment of FIG. 5, the symmetrical pattern 520 substantially has a diamond shape. Specifically, the diamond shape of the symmetrical pattern 520 may be divided into a first straight line 531, a second straight line 532, and a third straight line 533, which are substantially parallel to each other. For example, the total number of antenna elements 510 of the antenna array 500 may be 4. There may be 1 antenna element 510 arranged on the first straight line 531. There may be 2 antenna elements 510 arranged on the second straight line 532. There may be 1 antenna element 510 arranged on the third straight line 533. Other features of the antenna array 500 of FIG. 5 are similar to those of the antenna array 400 of FIG. 4A and FIG. 4B. Therefore, the two embodiments can achieve similar levels of performance.

Figure 6:
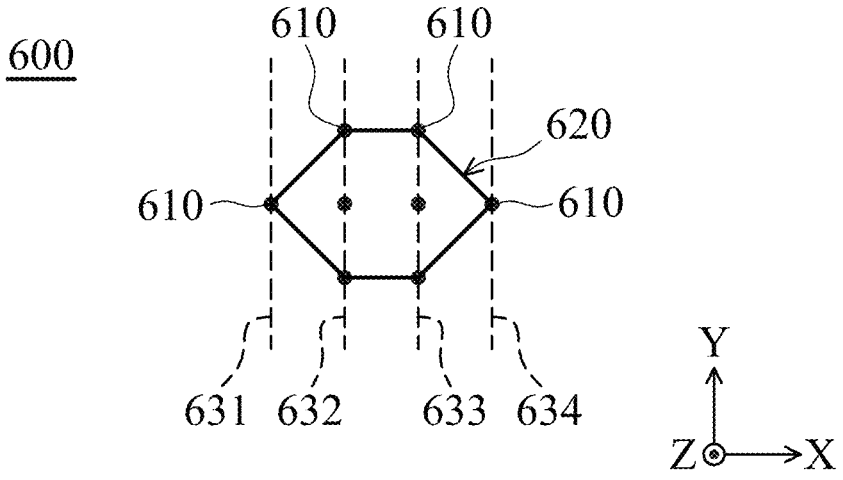
FIG. 6 is a top view of an antenna array according to an embodiment of the invention.

FIG. 6 is a top view of an antenna array 600 according to an embodiment of the invention. As shown in FIG. 6, the antenna array 600 includes a plurality of antenna elements 610, which are all disposed on the same plane. The antenna elements 610 are arranged to form a symmetrical pattern 620, which is neither square nor rectangular. The antenna elements 610 have the same output power. In the embodiment of FIG. 6, the symmetrical pattern 620 substantially has a diamond shape. Specifically, the diamond shape of the symmetrical pattern 620 may be divided into a first straight line 631, a second straight line 632, a third straight line 633, and a fourth straight line 634, which are substantially parallel to each other. For example, the total number of antenna elements 610 of the antenna array 600 may be 8. There may be 1 antenna element 610 arranged on the first straight line 631. There may be 3 antenna elements 610 arranged on the second straight line 632, and the distance between any two adjacent antenna elements 610 on the second straight line 632 may be the same. There may be 3 antenna elements 610 arranged on the third straight line 633, and the distance between any two adjacent antenna elements 610 on the third straight line 633 may be the same. There may be 1 antenna element 610 arranged on the fourth straight line 634. Other features of the antenna array 600 of FIG. 6 are similar to those of the antenna array 400 of FIG. 4A and FIG. 4B. Therefore, the two embodiments can achieve similar levels of performance.

Figure 7:
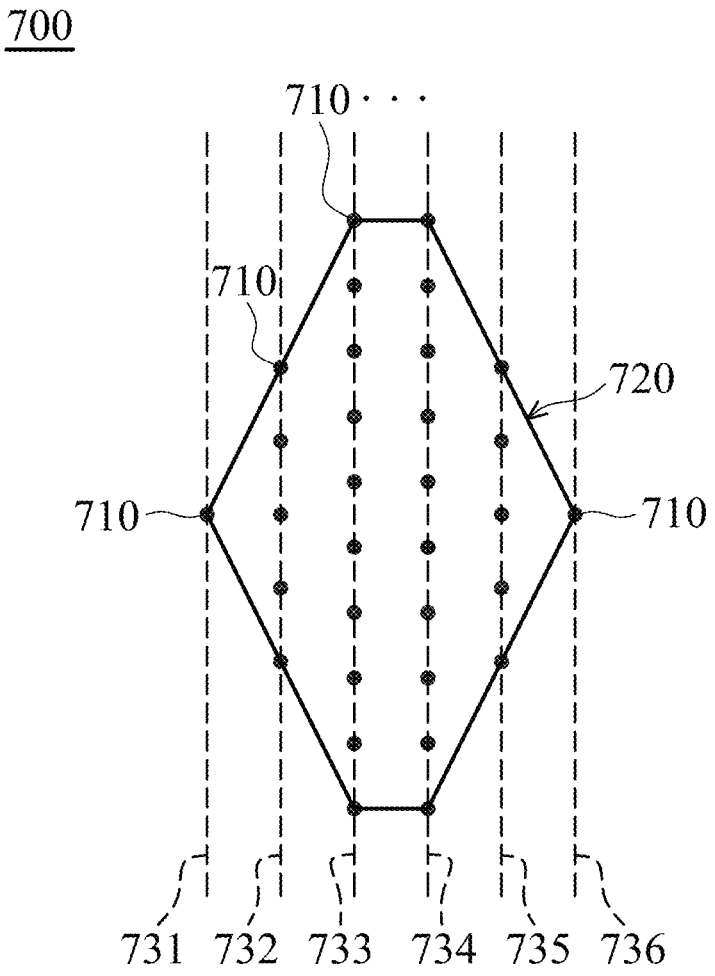
FIG. 7 is a top view of an antenna array according to an embodiment of the invention.

FIG. 7 is a top view of an antenna array 700 according to an embodiment of the invention. As shown in FIG. 7, the antenna array 700 includes a plurality of antenna elements 710, which are all disposed on the same plane. The antenna elements 710 are arranged to form a symmetrical pattern 720, which is neither square nor rectangular. The antenna elements 710 have the same output power. In the embodiment of FIG. 7, the symmetrical pattern 720 substantially has a diamond shape. Specifically, the diamond shape of the symmetrical pattern 720 may be divided into a first straight line 731, a second straight line 732, a third straight line 733, a fourth straight line 734, a fifth straight line 735, and a sixth straight line 736, which are substantially parallel to each other. For example, the total number of antenna elements 710 of the antenna array 700 may be 32. There may be 1 antenna element 710 arranged on the first straight line 731. There may be 5 antenna elements 710 arranged on the second straight line 732, and the distance between any two adjacent antenna elements 710 on the second straight line 732 may be the same. There may be 10 antenna elements 710 arranged on the third straight line 733, and the distance between any two adjacent antenna elements 710 on the third straight line 733 may be the same. There may be 10 antenna elements 710 arranged on the fourth straight line 734, and the distance between any two adjacent antenna elements 710 on the fourth straight line 734 may be the same. There may be 5 antenna elements 710 arranged on the fifth straight line 735, and the distance between any two adjacent antenna elements 710 on the fifth straight line 735 may be the same. There may be 1 antenna element 710 arranged on the sixth straight line 736. Other features of the antenna array 700 of FIG. 7 are similar to those of the antenna array 400 of FIG. 4A and FIG. 4B. Therefore, the two embodiments can achieve similar levels of performance.

Generally, the antenna elements over the diamond shape of each symmetrical pattern are arranged according to binomial coefficients. If such a diamond shape is divided into N parallel straight lines, the number of antenna elements arranged on the k-th straight line will be represented as $C_{k-1}^{N-1}$. For example, if 5 parallel straight lines are applied, there will be $1(C_0^4)$, $4(C_1^4)$, $6(C_2^4)$, $4(C_3^4)$, and $1(C_4^4)$ antenna element(s) arranged on the first, second, third, fourth, and fifth straight lines, respectively. In alternative embodiments, more antenna elements may be designed over the aforementioned diamond shape, and therefore the corresponding antenna array can generate a longer communication distance.

The invention proposes a novel antenna array, whose antenna elements are arranged to form a non-rectangular symmetrical pattern. Each antenna element has equal output power. In comparison to conventional designs, the invention has at least the advantages of suppressing the side lobe and increasing the communication distance, and therefore it is suitable for application in a variety of communication devices to improve the communication distance and the spatial efficiency.

Note that the above element sizes, element shapes, and frequency ranges are not limitations of the invention. An antenna designer can fine-tune these settings or values to meet different requirements. It should be understood that the antenna array of the invention is not limited to the configurations of FIGS. 1-7. The invention may merely include any one or more features of any one or more embodiments of FIGS. 1-7. In other words, not all of the features displayed in the figures should be implemented in the antenna array of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna array, comprising:

a plurality of antenna elements, disposed on a plane;

wherein the antenna elements are arranged to form a symmetrical pattern, and the symmetrical pattern is neither square nor rectangular;

wherein the antenna elements have the same output power;

wherein the antenna array covers an operation frequency band from 27 GHz to 29 GHz;

wherein a distance between any two adjacent antenna elements is shorter than or equal to 0.5 wavelength of the operation frequency band.

2. The antenna array as claimed in claim 1, wherein a radiation pattern of the antenna array includes a main lobe and a side lobe, and the main lobe is higher than the side lobe by at least 18 dB.

3. The antenna array as claimed in claim 1, wherein the symmetrical pattern substantially has a regular hexagonal shape, and the antenna elements are distributed over a periphery and an interior of the regular hexagonal shape.

4. The antenna array as claimed in claim 3, wherein the regular hexagonal shape is divided into a first straight line, a second straight line, a third straight line, a fourth straight line, a fifth straight line, a sixth straight line, a seventh straight line, an eighth straight line, and a ninth straight line which are substantially parallel to each other.

5. The antenna array as claimed in claim 4, wherein five of the antenna elements are arranged on the first straight line, six of the antenna elements are arranged on the second straight line, seven of the antenna elements are arranged on the third straight line, eight of the antenna elements are arranged on the fourth straight line, nine of the antenna elements are arranged on the fifth straight line, eight of the antenna elements are arranged on the sixth straight line, seven of the antenna elements are arranged on the seventh straight line, six of the antenna elements are arranged on the eighth straight line, and five of the antenna elements are arranged on the ninth straight line.

6. An antenna array, comprising:

a plurality of antenna elements, disposed on a plane;

wherein the antenna elements are arranged to form a symmetrical pattern, and the symmetrical pattern is neither square nor rectangular;

wherein the antenna elements have the same output power;

wherein the symmetrical pattern substantially has a concentric circular shape, and the antenna elements are distributed over a periphery and an interior of the concentric circular shape.

7. The antenna array as claimed in claim 6, wherein the concentric circular shape is divided into a first circumference, a second circumference, a third circumference, a fourth circumference, and a fifth circumference which share a center of a circle.

8. The antenna array as claimed in claim 7, wherein one of the antenna elements is arranged at the center of the circle, four of the antenna elements are arranged on the first circumference, eight of the antenna elements are arranged on the second circumference, twelve of the antenna elements are arranged on the third circumference, sixteen of the antenna elements are arranged on the fourth circumference, and twenty of the antenna elements are arranged on the fifth circumference.

9. An antenna array, comprising:

a plurality of antenna elements, disposed on a plane;

wherein the antenna elements are arranged to form a symmetrical pattern, and the symmetrical pattern is neither square nor rectangular;

wherein the antenna elements have the same output power;

wherein the symmetrical pattern substantially has a diamond shape, and the antenna elements are distributed over a periphery and an interior of the diamond shape.

10. The antenna array as claimed in claim 9, wherein the antenna elements over the diamond shape are arranged according to binomial coefficients.

11. The antenna array as claimed in claim 9, wherein the diamond shape is divided into a first straight line, a second straight line, and a third straight line which are substantially parallel to each other.

12. The antenna array as claimed in claim 11, wherein one of the antenna elements is arranged on the first straight line, two of the antenna elements are arranged on the second straight line, and one of the antenna elements is arranged on the third straight line.

13. The antenna array as claimed in claim 9, wherein the diamond shape is divided into a first straight line, a second straight line, a third straight line, and a fourth straight line which are substantially parallel to each other.

14. The antenna array as claimed in claim 13, wherein one of the antenna elements is arranged on the first straight line, three of the antenna elements are arranged on the second straight line, three of the antenna elements are arranged on the third straight line, and one of the antenna elements is arranged on the fourth straight line.

15. The antenna array as claimed in claim 9, wherein the diamond shape is divided into a first straight line, a second straight line, a third straight line, a fourth straight line, and a fifth straight line which are substantially parallel to each other.

16. The antenna array as claimed in claim 15, wherein one of the antenna elements is arranged on the first straight line, four of the antenna elements are arranged on the second straight line, six of the antenna elements are arranged on the third straight line, four of the antenna elements are arranged on the fourth straight line, and one of the antenna elements is arranged on the fifth straight line.

17. The antenna array as claimed in claim 9, wherein the diamond shape is divided into a first straight line, a second straight line, a third straight line, a fourth straight line, a fifth straight line, and a sixth straight line which are substantially parallel to each other.

18. The antenna array as claimed in claim 17, wherein one of the antenna elements is arranged on the first straight line, five of the antenna elements are arranged on the second straight line, ten of the antenna elements are arranged on the third straight line, ten of the antenna elements are arranged on the fourth straight line, five of the antenna elements are arranged on the fifth straight line, and one of the antenna elements is arranged on the sixth straight line.

* * * * *